United States Patent [19]

Watkins

[11] Patent Number: 4,716,604

[45] **Date of Patent: * Jan. 5, 1988**

[54] SPA WITH MOVING JETS

[75] Inventor: Jonathan Watkins, San Marcos, Calif.

[73] Assignee: Watkins Manufacturing Co., Carlsbad, Calif.

[ * ] Notice: The portion of the term of this patent subsequent to Jun. 18, 2002 has been disclaimed.

[21] Appl. No.: 777,435

[22] Filed: Sep. 18, 1985

[51] Int. Cl.[4] ..... A61H 33/02

[52] U.S. Cl. ..... 4/542; 4/492; 138/110; 138/155; 239/229; 285/45

[58] Field of Search ..... 4/490, 492, 507, 541–544, 4/567–569, 601, 615, 191; 138/110, 120, 155, 109; 285/45, 330; 339/104; 239/225, 229, 255, 587; 446/156, 159

[56] References Cited

U.S. PATENT DOCUMENTS

| | | | |
|---|---|---|---|
| 1,630,588 | 5/1927 | Sperry | 138/120 |
| 1,986,220 | 1/1935 | Russell | 239/229 |
| 2,748,803 | 6/1956 | Guarnaschelli | 138/120 |
| 2,772,421 | 12/1956 | Friend . | |
| 3,092,101 | 6/1963 | Kinney . | |
| 3,286,712 | 11/1966 | Roden . | |
| 3,315,692 | 4/1967 | Arneson | 239/229 X |
| 3,391,411 | 7/1968 | Miller . | |
| 3,420,226 | 1/1969 | Berry . | |
| 3,452,370 | 7/1969 | Jacuzzi . | |
| 3,474,469 | 10/1969 | Steltz . | |
| 3,820,172 | 6/1974 | Kane | 4/490 |
| 3,840,183 | 10/1974 | Kuribayashi | 239/318 X |
| 3,902,529 | 9/1975 | Brown . | |
| 3,986,217 | 10/1976 | Doerr . | |
| 4,044,953 | 8/1977 | Vogel | 239/229 |
| 4,142,337 | 3/1979 | Holcomb . | |
| 4,166,296 | 9/1979 | Darrah . | |
| 4,170,044 | 10/1979 | Steimle . | |
| 4,220,145 | 9/1980 | Stamp et al. | 4/542 X |
| 4,225,984 | 10/1980 | Lindsey . | |
| 4,230,276 | 10/1980 | Tinder et al. | 239/229 |
| 4,233,694 | 11/1980 | Janosko . | |
| 4,339,833 | 7/1982 | Mandell | 4/542 |
| 4,346,484 | 8/1982 | Martin | 4/492 |
| 4,523,340 | 6/1985 | Watkins | 4/492 |

*Primary Examiner*—Henry J. Recla
*Assistant Examiner*—Linda J. Sholl
*Attorney, Agent, or Firm*—Duane C. Bowen

[57] ABSTRACT

A flexible tube exhausting pumped water into a spa tank and whipping by reaction to exhaust of water therefrom. A number of articulated plastic sleeves encircling the tube and guiding the tube to whip only in a vertical plane. The sleeves being pivotally connected to pivot about horizontal parallel axes. Adjacent sleeves having abutments limiting bending of the harness and the tube. An end sleeve being secured against rotation but being slidable longitudinally of the tube so that the harness can adjust longitudinally of the tube during whipping of the tube.

15 Claims, 9 Drawing Figures

SPA WITH MOVING JETS

BRIEF SUMMARY OF THE INVENTION'S BACKGROUND AND OBJECTIVES

My invention relates to a spa having a flexible tube whipping by reaction force due to exhaust of pressurized water. The tube is guided to whip in a single plane by a harness formed by a series of sleeves encircling the tube and connected to pivot about parallel axes extending at right angles to that plane.

My prior inventions concerning spas with moving jets include the following:

(a) Ser. No. 06/243,724, filed 3/16/81, now abandoned.

(b) U.S. Pat. No. 4,523,340, issued 6/18/85.

(c) Ser. No. 06/665,445, filed 10/26/84, now abandoned.

Users of spas enjoy my moving jets, which can be directed up and down the back, etc., as a gentle source of massage. My system of moving a jet in a spa is to propel a flexible tube to whip automatically by exhaust of pumped water. The water is being recirculated in spas in any case, for filtration of water, so I take advantage of an existing source of power to move the jet.

It has proven difficult, however, to provide the degree of reliability on such a whipping tube system that I consider to be desirable or needed. Upon failure, the water jet remains in some fixed position. The user might be able to reestablish the normal cycle of the jet by a simple adjustment or merely by again start the tube in motion, but I would like the system to work indefinitely, or at least until the tube has had a normal life, without any attention by the user to maintain whipping action. Causes of difficulty include:

(a) Variations in flexibility of the plastic or rubber tube despite the purchase of expensive materials. I have been using a 40 Durometer Shore-A flourosilicone manufactured by Dow Corning but significant variations in flexibility are encountered even in this high performance material.

(b) Variations in flexibility of the plastic or rubber tube due to aging and corrosive effects of disinfectants.

(c) Variations in dimensions of parts within suitable manufacturing tolerances.

(d) Limits of mass production. It is desirable that manufacture and assembly of the product can be achieved with needed reliability in routine mass production. Whereas higher reliability could be achieved by use of skilled personnel to adjust of "fine tune" the system, such deviation from mass production by lower cost personnel is understandably undesirable. The system should work despite the assumption that anything that can be "out of synch" will be "out of synch" in mass production.

It is an objective of my invention to increase reliability of whipping action of such spa jet tubes and to reduce the above discussed problems. More specifically, it is an objective of my invention to increase reliability by use of a harness (a) restricting whipping movement to a single vertical or other selected plane, and (b) limiting the amount of movement in the selected plane in terms of the distance of movement of the end of the tube or in terms of the angle with the horizontal the axis of the end of the tube makes at its limits, compared with the neutral position of the tube.

Further objectives of my invention include: to provide such a harness with reliable action, of economical cost, not requiring maintenance, and not requiring adjustment either upon original manufacture or during use.

My invention will be best understood, together with additional advantages and objectives thereof, when read with reference to the drawings.

DRAWINGS

GENERAL DESCRIPTION

Figure 2:
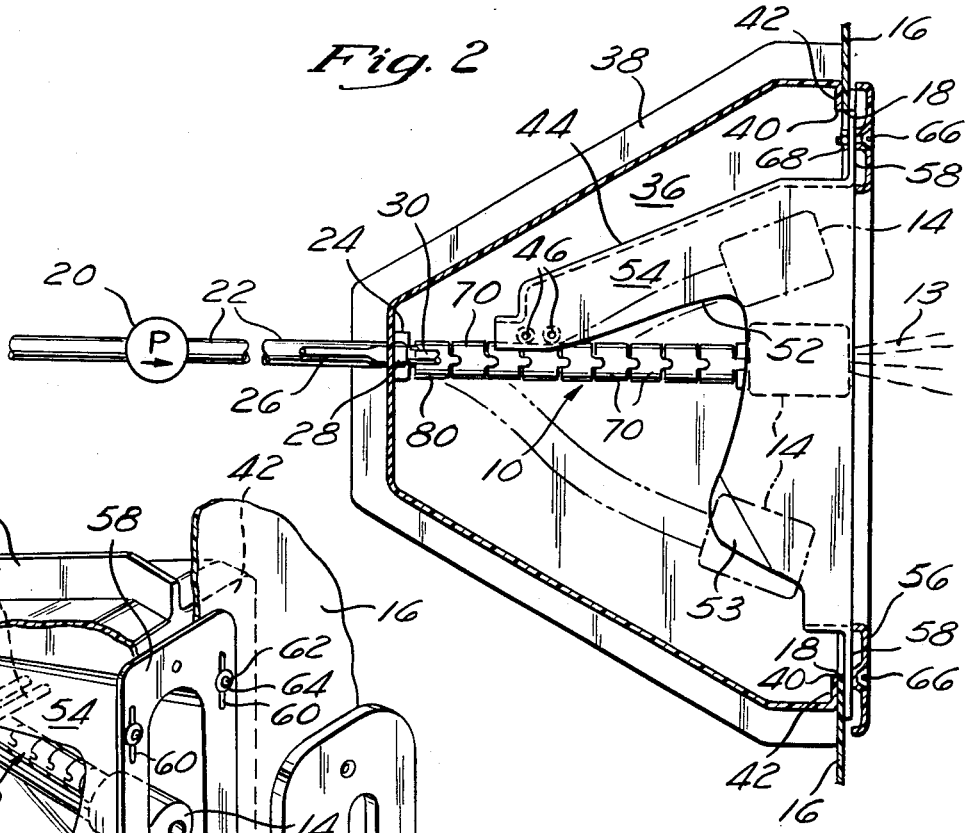
FIG. 2 is a side view, partly in section. Tube and nozzle movement is indicated in dashed lines.
Figure 1:
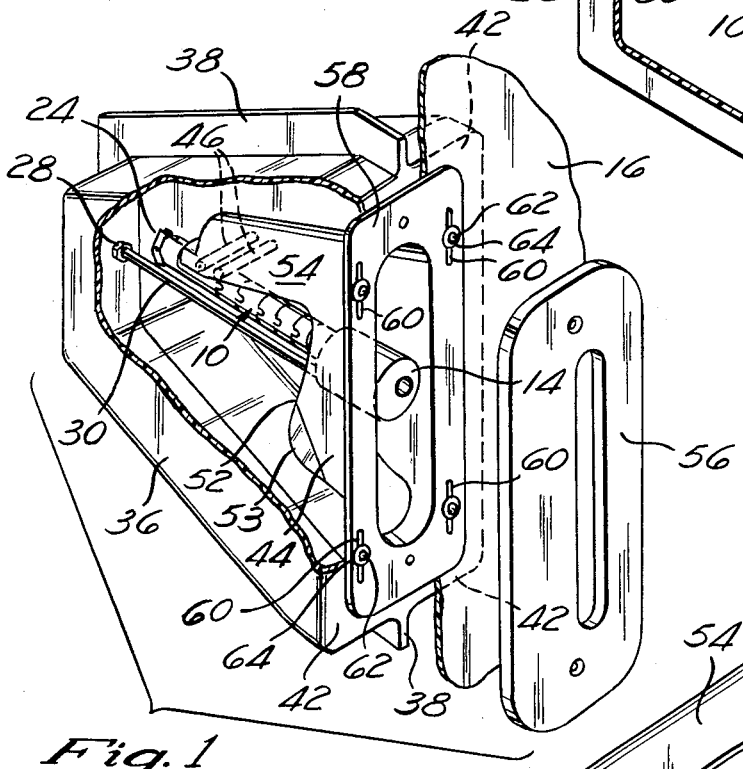
FIG. 1 is a perspective view of a specific embodiment of my invention. Structure is cut away and the face plate is disposed in exploded position to reveal otherwise hidden structure.
Figure 3:
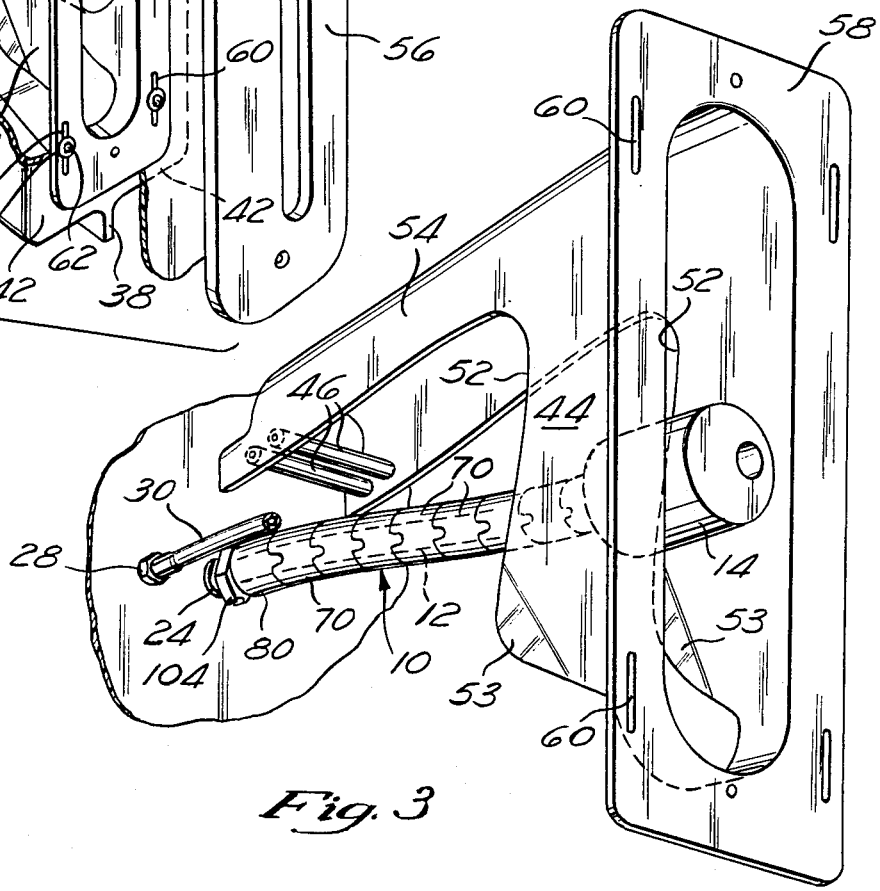
FIG. 3 is a partial perspective view.

Some of the structure shown in the drawings is similar to that shown in the prior patent of the inventors, U.S. Pat. No. 4,523,340 and in the prior copending applications of the inventors, Ser. No. 06/243,724 and Ser. No. 06/665,445. The improvement of the present patent application concerns most importantly the use of a harness 10 to guide the flexible tube 12 that whips by reaction of water 13 exhausting therefrom. Harness 10 is new to this application whereas most of the other structure was shown in the prior applications. I will first review the mostly old structure before describing harness 10.

Tube 12 has a nozzle 14 directed to exhaust water into a tank of a spa or the like containing water for body immersion. The water stream 13 is used to play upon or massage the body of a user. A portion of the tank wall is shown at 16. Tank wall 16 is slotted at 18 to provide an opening for exhaust of water from nozzle 14. A recirculation pump 20 is connected by a tube 22 to a fitting 24 connecting to flexible tube 12 to provide pressurized water to tube 12. Atmospheric air is drawn by vacuum through a tube 26 connecting to a fitting 28 connecting to a flexible air tube 30 that attaches to nozzle 14. Air mixes with the water stream passing through nozzle 14 in a Venturi manner to supply additional thrust to the water 13 ejecting from nozzle 14. Air tube 30 should have some slack relative to harness 10 and tube 12, to avoid interfering with the whipping movement of tube 12. Nozzle 14 has an air chamber 32 adding buoyancy to nozzle 14. Air ejects into the water stream 13 through space or slot 34. Nozzle 14 is more thoroughly shown and described in my prior patent application No. 06/665,445.

A housing 36 encloses harness 10, flexible tube 12, nozzle 14, air tube 30, etc. It is shown as being formed of two halves having flanges 38 bonded together. A slot 40 in housing 36 matches slot 18 in tank wall 16 and flanges 42 about slot 40 are bonded to tank wall 16. Fittings 24, 28 are secured in openings in the end of housing 36.

A guide body 44 is disposed within housing 36 and forms guides at the sides of nozzle 14. Usually guide body 44 will guide nozzle 14 to move in a vertical plane, harness 10 will guide flexible tube 12 to whip in a vertical plane, etc. It will be evident, however, that housing 36, guide body 44, slots 18, 40, etc. could be changed in orientation ninety degrees so that nozzle 14 and flexible tube 12 would move in a horizontal plane. If housing 36 were rotatably mounted, orientation of whipping of flexible tube 12 could even be changed in plane from vertical to horizontal or even to oblique. If the parts were oriented so that flexible tube 12 were to whip in a horizontal plane, abutments 46 would have to be provided at both ends of the travel of tube 12.

Figures 4, 5, 6:
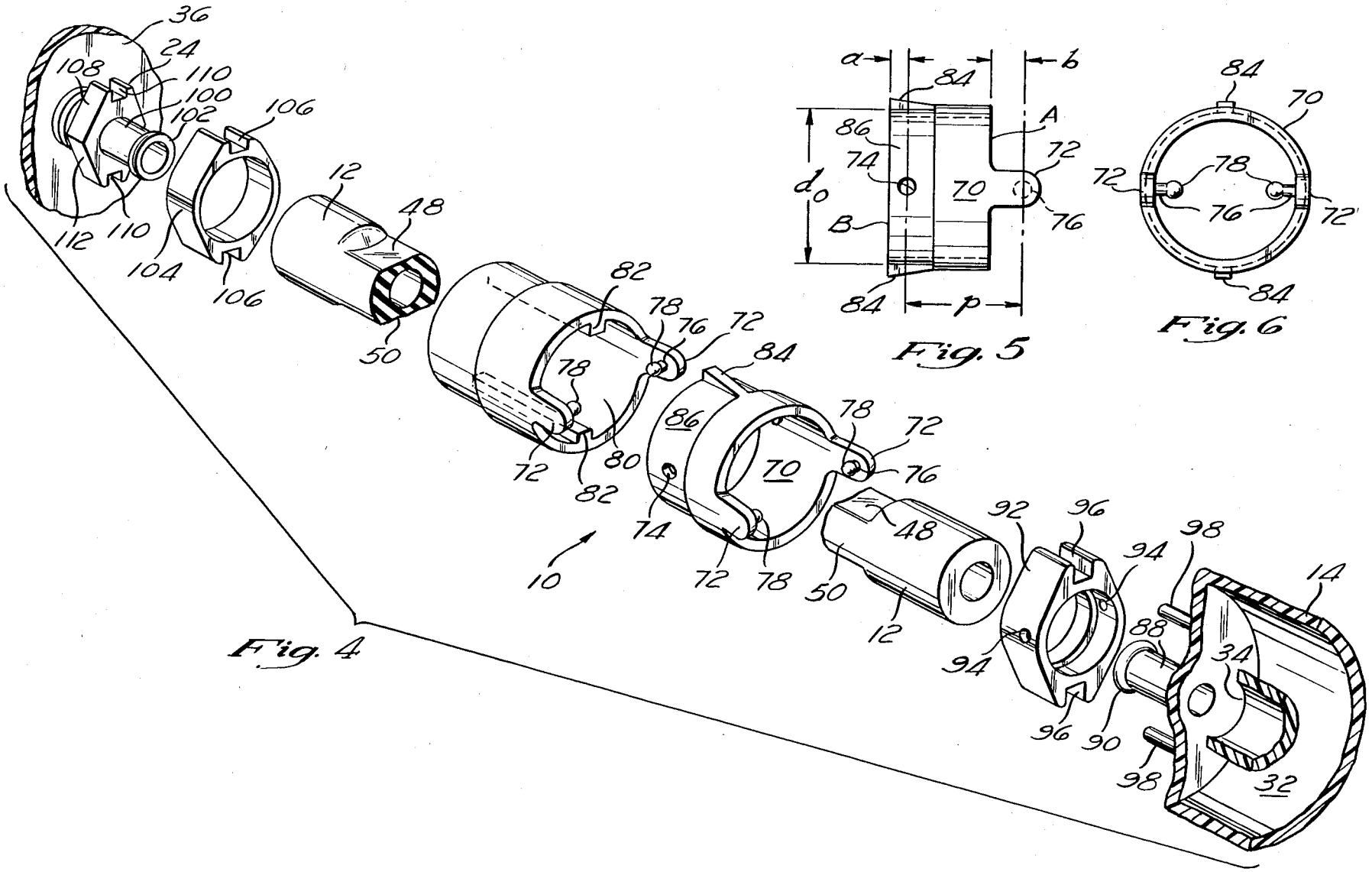
FIG. 4 is an exploded perspective view of tube, nozzle, and harness.
FIG. 5 is a side view of a harness sleeve.
FIG. 6 is an end view of a harness sleeve.

Tube 12 is flattened on upper and lower surfaces 48, 50 as shown in FIG. 4, except at its ends that have full diameters to stretch over nipples. As described in more detail in Ser. No. 06/665,445, a tube 12 thus shaped has a longer horizontal major axis and a shorter vertical minor axis and till tend inherently to whip in a vertical plane, when water exhausts therefrom, regardless of any exterior guidance. Therefore, harness 10 merely corrects any tendency of tube 12 to deviate from a vertical plane (due to factors such as tolerances of manufacture, material imperfections, material aging, etc.) as a secondary guidance system (the inherent tendency to whip vertically due to tube shape being primary guidance). Guide body 44 is a tertiary guidance system at the sides of nozzle 14 to further correct any deviation of the whipping of tube 12 from a vertical plane. Experience has indicated that limited rubbing of the sides of nozzle 14 on guide body 44 appropriately slows the whipping of tube 12 from moving too fast, but guide body 44 is cut back at 52 so that harness 10 won't rub against guide body 44 because experience has indicated that friction between harness 10 and guide body 44 would slow whipping of tube 12 excessively. However, there are other factors involved such as sizes of parts, the frictional properties of materials used, the surface finish of materials, etc., so guide body 44 could be differently configured if other factors changed. At present, nozzle 14 is made of an ABS plastic and harness 10 and guide body 44 are formed of a polyethylene which has a low order of friction. The lower ends 53 of guide body 44 may be flared to guide nozzle 14 back between the sidewalls of guide body 44 should nozzle 14 travel too far downwardly so as to escape from guide body 44.

Guide body 44 has an upper arm 54 that supports the pair of roller abutments 46 rotatably mounted in openings in opposite walls of arm 54. When harness 10 in upward movement strikes rollers, flexible tube 12 tends to reverse direction, in an undulating manner, and start back downwardly. Therefore, roller abutments 46 limit how high nozzle 14 will go and the angle thereof, so that the height of the jet water stream 13 exhausting from nozzle 14 is controlled. The height of rollers 46 can be changed by adjusting the vertical position of the supporting guide body 44. When the roller heights are changed, then the height and angle of water exhaust stream 13 will change. For example, if stream 13 where discharging, in its highest position, above the water surface in the water tank of the spa, then guide body 44 could be lowered so that stream 13 would remain below the surface of the tank water. A user may be using stream 13 for back massage and may wish to change the height of travel of stream 13 in order to modify the area of the back being massaged, and that can be done by changing the height of guide body 44. Guide body is adjusted in height by manual force applied to the mouth of guide body 44 or to a face plate 56 covering the flanges 58 of body 44. Flanges 58 have vertically oriented slots 60 permitting adjustment of guide body 44 on bolts 62 secured to the double thickness of tank wall 16 and housing flange 42. Polyethylene washers 64 on bolts 62 facilitate sliding of guide body 44 relative to the heads of bolts 62. Face plate 56 is secured to flanges 58 by bolts 66 and nuts 68.

HARNESS

Harness 10 is formed by a series of articulated sleeves 70 pivotally connected together in series and encircling flexible tube 12 and guiding tube 12 in whipping motion by limiting flexing of tube 12 substantially to the flexing limitations of harness 10. Harness 10 is restricted in articulated movement substantially to a vertical plane in the configuration illustrated (or to other selected plane in alternate orientation). This vertical plane extends through tank wall 16 radially into the tank of water of the spa.

Sleeves 70 are pivotally connected to pivot about parallel axes at right angles to the vertical plane, i.e., about horizontal axes, so that sleeves 70 can only pivot in that vertical plane and whereby tube 12 can only whip in that vertical plane. Pivotal connections are obtained between adjacent sleeves 70 by each sleeve having a pair of ears 72 disposed on opposite sides and lapping an adjacent sleeve 70 that has openings 74 aligned with ears 72 and having pivot pins 76 engaged in openings 74, the parallel axes extending centrally through pivot pins 76 and openings 74. Sleeves 70 are molded from plastic, preferably polyethylene, and pins 76 are molded integrally therewith in the form of inwardly extending pins with inner enlarged bulbous portions 78 popping in and out of openings 74 under force to secure pins 76 in openings 74. The popping of plastic pins 76 in and out of openings 74 is reminiscent of the manner of securing of plastic "pop beads" that were popular a couple of decades ago.

Preferably, there are at least six sleeves 70 and at least the majority are identical. In the configuration shown, there are nine sleeves 70 of which all are identical except for the end sleeve 80 at the fixed end of flexible tube 12 which is modified primarily by having upper and lower internal keys 82, for purposes later to be described. End sleeve 80 doesn't need openings 74 or abutments 84. Abutments 84 on sleeves 70 abut adjacent sleeves and limit the degree $\phi$ of pivoting therebetween. The end areas 86 of sleeves 70 that ears 72 lap are preferably of reduced diameter. Upper and lower abutments 84 are provided on reduced diameter ends 86 to obtain good abutment surfaces between adjacent sleeves 70. Otherwise, the abutment surfaces would not be good without the special abutments 84, as may be observed particularly from FIG. 7. The abutments 84 limit bending of harness 10 when sleeves 70 have pivoted selected angles $\phi$ during whipping of tube 70. For economy of manufacture, assembly, etc., it will be understood usually all angles $\phi$ will have the same value. Other abutment means limiting pivoting of adjacent sleeves 70 could be substituted but the use of abutments 84, molded with sleeves 70, is an effective, economical design.

Nozzle 14 has a nipple 88 with an end annular bead 90 and flexible tube 12 is secured to nozzle 14 by being stretched over nipple 88 and by the use of a polyethylene collar 92 forced over tube 12 and nipple 88. Collar 92 has a pair of side openings 94 and the adjacent sleeve 70 laps collar 92 and has pins 76 secured in openings 94. The top and bottom of collar 92 is increased in diameter and have slots 96 in which are fitted upper and lower pins 98 on nozzle 14, which insure that nozzle 14 is properly oriented relative to harness 10. Flexible air tube 26 is appropriately secured to nozzle 14 and communicates with nozzle air chamber 32.

Fitting 24 securing flexible water tube 12 to the outer end of housing 36 includes a nipple 100 with an end annular bead 102. Tube 12 stretches over nipple 100 and is secured by the use of a polyethylene collar 104 forced over tube 12 and nipple 100. The top and bottom of collar 92 is increased in diameter and have keyway slots 106. Fitting 24 has a flange 108 and flange 108 has upper and lower keyway slots 10 aligned with keyway slots 106. Flange 108 was derived from a nexagonal flange and the corners 112 are useful in obtaining proper horizontal-vertical alignment of fitting 24 and harness 10 connected thereto. Upper and lower internal keys 82 inside end sleeve 80 fit in keyway slots 106, 110 and orient harness 10 as to vertical and horizontal while permitting harness 10 to slide longitudinally of fitting 24 to adjust longitudinally of flexible tube 12 as tube 12 whips. Collar 104 could be considered to be another link of harness 10 but one secured against pivoting. Likewise, collar 92 can be considered to be another link of harness 10 but one pivoting in unison with nozzle 14.

ANALYSIS OF HARNESS GEOMETRY

I will now set forth an analysis of harness 10 as to how geometrical relationships are designed and controlled to limit flexing of flexible tube 12. Reference is made especially to FIGS. 5–9.

The harness design, in analysis, consists of a series of sleeve links 70 connected at pivot points 74, each link 70 being an annulus, or ring, surrounding flexible tube 12. Each link 70 has two pins 76 attached, and located distance "b" from face B (front face, or tow), and two holes 74 distance "a" from face A (back face, or heel); the pitch distance between pins 76 and holes 74 is "p". Although details of the design of links 70 may vary, the parameters, a, b, p and d, determine its function.

Each link 70 is connected to the adjoining link 70 by the pins 76 being inserted in the corresponding holes 74 (by a temporary deformation of the link). Thus, one link 70 can rotate relative to the other about pins 76, until abutment occurs at point C. The maximum angle through which a link 70 can rotate relative to another is denoted as $\phi$, and is given, approximately, by:

$$\phi = 2\frac{b-a}{d_o} \text{ (radians)}, \tag{1a}$$

$$\phi = \frac{360°}{\pi}\ \frac{b-a}{d_o} \text{ (degrees)}. \tag{1b}$$

Figure 7:
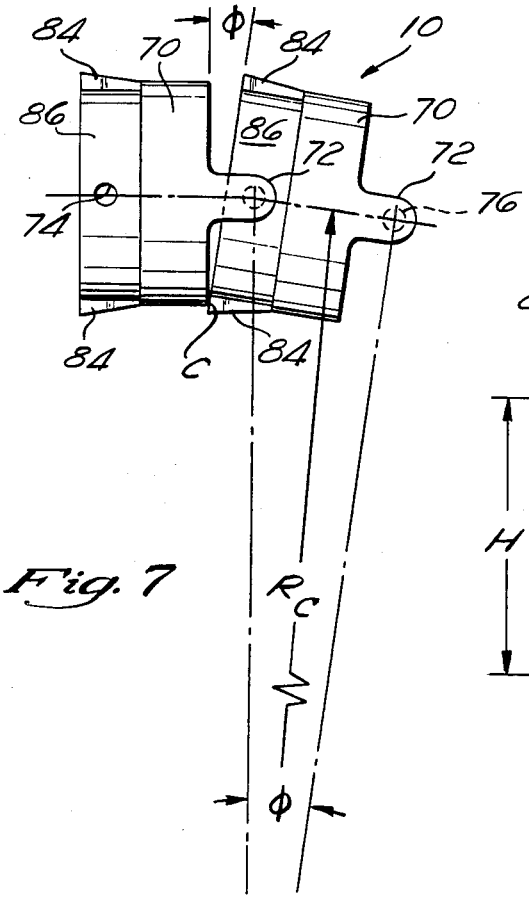
FIG. 7 is a side view of a pair of harness sleeves with indication of geometrical relationships.

Corresponding to $\phi$ there is an equivalent radius of curvature, shown in FIG. 7, which is given by:

$$R_c = \frac{1}{2}\ \frac{pd_o}{b-a}. \tag{2}$$

Figure 8:
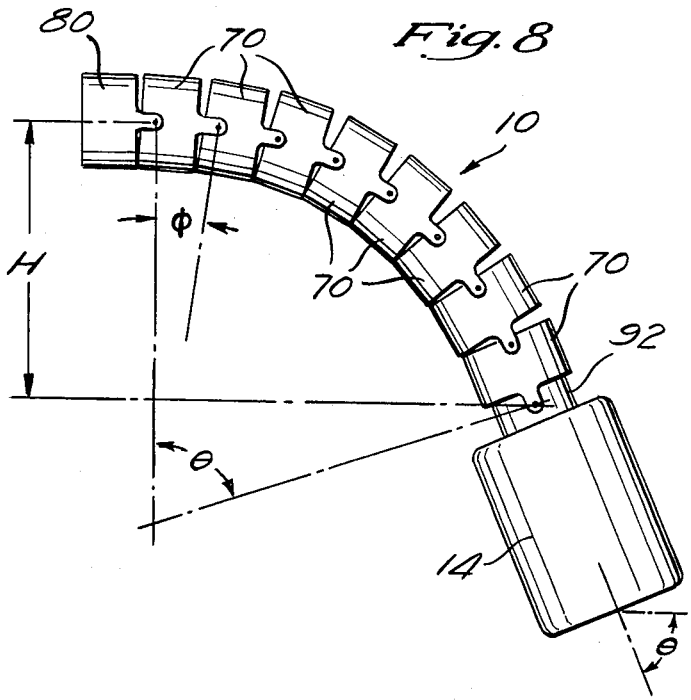
FIG. 8 is a side view of a harness and nozzle assembly with indication of geometrical relationships.

In application, N movable links 70 are connected together (the base link 80 being in fixed position relative to pivoting) forming the sector of an arc, as shown in FIG. 8. As the angle of this sector, $\theta$, is made up of N of angle $\phi$, the maximum deflection angle is $$\theta = N\phi. \tag{3}$$

Corresponding to this angle, the maximum displacement (below the horizontal position) of the last link 70 (connected to Nozzle 14) is given by $$H = R_c(1-\cos\theta) \tag{4}$$

Hence, it is seen that the extreme position of the nozzle in FIG. 8 is limited by the interconnected links 70 (limiter), and that this position is fully determined by the parameters a, b, p and $d_o$ of each individual link 70.

As an example, consider a design employing 8 movable links 70, and one fixed link 80, where $b-a=0.110''$, $d_o=1{,}370''$, and $p=0.944''$. In this case $$\phi = \frac{360°}{\pi}\cdot\frac{0.110}{1.370} = 9.2°,$$

$$\theta = 8 \times 9.2 = 73.6°,$$

$$R_c = \frac{1}{2}\ \frac{0.994 \times 1.370}{0.110} = 5.88'',$$

$$H = 5.88''\ [1 - \cos(73.6°)] = 4.22''.$$

Thus, for this design, the base of nozzle 14 is limited to a position of 4.22" below (or above) horizontal, and a maximum deflection angle of 73.6 degrees.

Figure 9:
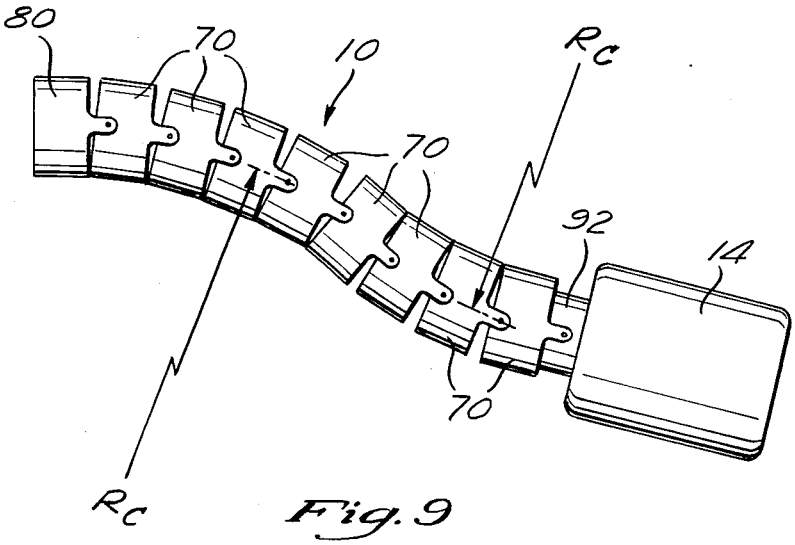
FIG. 9 is a side view of a harness and nozzle assembly in undulating position.

Although harness 10, as described above, limits the extreme position of jet nozzle 14, it also has the function of limiting the radius of curvature, $R_c$, for intermediate positions of nozzle 14. As shown in FIG. 9, harness 10 prevents the curvature at any point from diminishing below $R_c$, thus stabilizing the motion and rendering it a regular and predictable oscillation between the extreme positions. The movement of flexible tube 12, as controlled by harness 10, has a machine-like movement which is noticeably different than the movement before experienced without harness 10.

Another feature of harness 10 is providing for an axial sliding motion, but non-rotating, at either extreme end of its length, relative to flexible tube 12 inside harness 10. As tube 12 flexes through its various positions there is relative axial motion with respect to harness at least partly because tube 12 tends not to remain on the center line of the linkage curve, but moves towards one side of the inside diameter of harness 10. This relative axial movement is taken up at either end of harness 10 by end link 80 having a sliding connection, rather than the fixed connections illustrated in FIGS. 8 and 9. Relative rotation is prevented by keys 82 (or keyways) being molded as part of base link 80, and corresponding keyways 106, 110 (or keys). It would be possible to have the equivalent of end link 80, keys 82 and keyways 106,110 at the nozzle end of harness 10 instead of end attached to housing 36. If a design were used in which both ends of harness 10 were fixed relative to tube 12, sleeves 70 would take thrust, a lot of friction would result, and experience indicates the assembly of harness 10 and tube 12 would not work nearly as well.

Another function of harness 10 is to provide lateral stability to the oscillating motion. In as much as links 70 can pivot in one plane only, spurious motions in planes other than the primary plane are avoided.

As described above, each link 70 is considered to have identical parameters, a, b, p and $d_o$. However, the design is not limited to such identical values. By varying the parameters for each individual link 70 in the chain, the minimum radius of curvature, $R_c$, can be designed to be a function of position along the chain, thus providing various advantageous limiting curve designs for the oscillating tube 12.

In addition to their limiting functions, the increased diameter of sleeve links 70 (relative to internal tube 12), and the interconnections, provide additional hydrodynamic drag, thus slowing down and regularizing the motion. Alternative link designs could incorporate special features to increase or decrease the hydrodynamic drag of harness 10.

Sleeves 70 are formed from polyethylene which has a capability of some deformation. The portion of sleeve 70 having ears 72 tends to spread and the portion of sleeve with openings 74 tends to compress. The polyethylene permits this deformation and tends to set in these altered configurations, in which the sleeve is changed from truly circular cross-sections to different oval cross-sections at either end.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having an end secured relative to said tank with said free end extending inwardly therefrom towards the inside of said tank, (b) a harness formed by a number of articulated sleeves pivotally connected together in series and encircling said tube and guiding said tube in whipping motion by limiting flexing of said tube substantially to the flexing limitations of said harness and said harness being restricted in articulated movement substantially to a vertical plane that extends through said tank, said sleeves being pivotally connected to pivot about parallel axes at right angles to said plane, so that said sleeves can only pivot in said plane and whereby said tube can only whip in said plane, pivotal connections being obtained between adjacent sleeves by each sleeve having a pair of ears disposed on opposite sides and lapping an adjacent sleeve that has openings aligned with said ears and said ears having pivot means engaged in said openings, said parallel axes extending through said pivot means and openings, (c) adjacent sleeves having abutment means meeting when said sleeves have pivoted selected angles thereby limiting bending of said harness and said tube during whipping of said tube, and (d) one of said sleeves at least at one end of said series being mounted slidably longitudinally of said tube while being secured against rotation relative to said tube whereby said harness can adjust longitudinally of said tube during whipping of said

2. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having a fixed end secured relative to said tank with said free end extending inwardly therefrom towards the inside of said tank, and (b) a harness formed by a number of separate articulated sleeves pivotally connected together in series by journals and bearings and closely encircling said tube and guiding said tube in whipping motion by limiting flexing of said tube substantially to the flexing limitations of said harness and said harness being restricted in articulated movement substantially to a vertical plane that extends through said tank, said sleeves being pivotally connected to pivot about parallel axes at right angles to said plane, so that said sleeves can only pivot in said plane and whereby said tube can only whip in said plane, said sleeves pivoting without appreciable resistance in said plane.

3. The subject matter of claim 2 in which there are at least six sleeves and at least the majority of said sleeves being identical.

4. The subject matter of claim 2 in which adjacent sleeves have means abutting when said sleeves have pivoted selected angles thereby limiting being of said harness and said tube during whipping of said tube.

5. The subject matter of claim 2 in which pivotal connections are obtained between adjacent sleeves by each sleeve having a pair of ears disposed on opposite sides and lapping an adjacent sleeve that has openings forming said bearings aligned with said ears and said ears having pins forming said journals disposed in said openings, said parallel axes extending through said pins and openings.

6. The subject matter of claim 5 in which said sleeves are formed of plastic material and said pins formed of plastic integral with the remainders of said sleeves and said pins are inwardly extending and said ears lap the outsides of adjacent sleeves, and in which said pins have outer portions fitting said openings and have inner enlarged bulbous portions popping in and out of said openings under force to secure said pins in said openings.

7. The subject matter of claim 6 in which said sleeves are reduced in diameter at one end which has said openings except at top and bottom where said sleeves have enlarged abutment lugs that abut adjacent sleeves as said harness bends up and down to limit said harness as to the degree of bending of said harness during whipping of said tube.

8. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having a fixed end secured relative to said tank with said free end extending inwardly therefrom towards the inside of said tank, (b) a harness formed by a number of articulated sleeves pivotally connected together in series and closely encircling said tube and guiding said tube in whipping motion by limiting flexing of said tube substantially to the flexing limitations of said harness and said harness being restricted in articulated movement substantially to a vertical plane that extends through said tank, said sleeves being pivotally connected to pivot about parallel axes at right angles to said plane, so that said sleeves can only pivot in said plane and whereby said tube can only whip is said plane, (c) pivotal connections formed between adjacent sleeves by each sleeve having a pair of ears disposed on opposite sides and lapping an adjacent sleeve that has openings aligned with said ears and said ears having pins disposed in said openings, said parallel axes extending through said pins and openings, and (d) a nozzle secured to said free end of said tube, said nozzle having a nipple and said tube fitting over said nipple and a collar fitting over the free end of said tube securing said tube to said nipple, said collar having a pair of openings at its sides and the adjacent sleeve having a pair of ears lapping said collar and having pins fitting in said openings in said collar, the top and bottom of said collar having slots and upper and lower pins on said nozzle fitting in said slots to secure said nozzle against rotation relative to said tube and harness.

9. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having a fixed end secured relative to said tank with said free end extending inwardly therefrom towards the inside of said tank, (b) a harness formed by a number of articulated sleeves pivotally connected together in series and closely encircling said tube and guiding said tube in whipping motion by limiting flexing of said tube substantially to the flexing limitations of said harness and said harness being restricted in articulated movement substantially to a vertical plane that extends through said tank, said sleeves being pivotally connected to pivot about parallel axes at right angles to said plane, so that said sleeves can only pivot in said plane and whereby said tube can only whip in said plane, and (c) the end sleeve at said fixed end of said tube having a pair of upper and lower internal keys, a fitting securing said tube relative to said tank including a fixed flange with upper and lower keyways and a nipple extending from said flange over which said fixed end of said tube fits and a collar fitting over said fixed end of said tube and securing said tube to said nipple and said collar having upper and lower keyways and said internal keys in said end sleeve fitting in said keyways and the end of said harness at said fixed end of said tube being oriented and secured against rotation by the engagement of said keys in said keyways but being free to slide longitudinally of said fitting by the action of said keys in said keyways whereby said harness can adjust longitudinally of said tube as said tube whips.

10. The improvement in a spa or the like, comprising:

(a) a tank containing water for body immersion and a flexible tube directed to exhaust water into said tank from a side thereof and a source of pressurized water connected to said tube, said tue having a free end adapted to whip by reaction of water exhausting therefrom for massage of users, said tube having a fixed end secured relative to said tank with said free end extending inwardly therefrom towards the inside of said tank, and (b) a harness formed by a number of separate articulated ring-shaped units pivotally connected together in series by journals and bearings and encircling said tube and guiding said tube in whipping motion by limiting flexing of said tube substantially to the flexing limitations of said harness and said harness being restricted in articulated movement substantially to a selected plane that extends through said tank, said ring-shaped units being pivotally connected to pivot about parallel axes at right angles to said plane, so that said ring-shaped units can only pivot in said plane and whereby said tube can only whip in said plane, said ring-shaped units pivoting without appreciable resistance in said plane.

11. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having a fixed end secured relative to said tank with said free end extending inwardly therefrom towards the inside of said tank, (b) a harness formed by a number of articulated ring-shaped units pivotally connected together in series and encircling said tube and guiding said tube in whipping motion by limiting flexing of said tube substantially to the flexing limitations of said harness and said harness being restricted in articulated movement substantially to a selected plane that extends through said tank, said ring-shaped units being pivotally connected to pivot about parallel axes at right angles to said plane, so that said ring-shaped units can only pivot in said plane and whereby said tube can only whip in said plane, and (c) adjacent ring-shaped units having means abutting when said units have pivoted a selected angle thereby limiting bending of said harness and said tube during whipping of said tube, one of said units at least at one end of said series being mounted slidably longitudinally of said tube while being secured against rotation relative to said tube whereby said harness can adjust longitudinally of said tube as said tube whips.

12. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having an end secured relative to said tank with said free end extending inwardly therefrom towards the inside of said tank, and (b) a harness formed by a number of separate articulated harness units pivotally connected together in series by journals and bearings and closely enclosing said tube and guiding said tube in whipping motion by limiting flexing of said tube substantially to the flexing limitations of said harness and said harness being restricted in articulated movement substantially to a selected plane that extends through said tank, whereby said tube can only whip in said plane, said harness units pivoting without appreciable resistance in said plane.

13. The subject matter of claim 12 which there is at least six pivotal harness units and one non-pivotal harness unit at said end of said tube secured relative to said tank, adjacent harness units having means abutting when said units have pivoted selected angles thererby limiting blending of said harness and said tube during whipping of said tube.

14. The improvement in a spa or the like, comprising:

(a) a tank containing water for body immersion and a flexible tube directed to exhaust water into said tank from a side thereof nd a source of pressurized water connected to said tube, said tube having a free end adapted to whip by reaction of water exhausting therefrom for massage of users, said tube having an end secured relative to said tank with said free end extending inwardly therefrom towards the inside of said tank, (b) a harness formed by a number of articulated harness units pivotally connected together in series and closely enclosing said tube and guiding said tube in whipping motion by limiting flexing of said tube substantially to the flexing limitations of said harness and said harness being restricted in articulated movement substantially to a selected plane that extends through said tank, whereby said tube can only whip in said plane, and (c) one of said units at least at one end of said series being mounted slidably longitudinally of said tube while being secured against rotation relative to said tube whereby said harness can adjust longitudinally of said tube during whipping of said tube.

15. The improvement in spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having an end secured relative to said tank with said free end extending inwardly therefrom towards the inside of said tank, and (b) a harness formed by a number of separate articulated harness sleeves pivotally connected together in series by journals and bearings and closely enclosing said tube and guiding said tube in whipping motion by limiting flexing of said tube substantially to the flexing limitations of said harness and said harness being restricted in articulated movement substantially to a vertical plane that extends through said tank, whereby said tube can only whip in said plane, pivotal connections being obtained between adjacent sleeves by each sleeve having a pair of ears disposed on opposite sides and lapping an adjacent sleeve that has openings aligned with said ears and pivot pins connecting said ears with said openings, said parallel axes extending through said pins and openings, adjacent harness sleeve having portions abutting when said sleeves have pivoted related selected amounts thereby limiting bending of said harness and said tube during whipping of said tube, said tube bending to a maximum selected displacement below a horizontal position according to the formula $$H=R_c(1\text{-}\cos\theta)$$

wherein "H" is said maximum selected displacement, "$R_c$" is radius of curvature, and "$\theta$" is the angle between lateral axes of end harness sleeves, and wherein $$R_c = \frac{1}{2}\frac{pd_o}{b-a}$$

"p" being the distance between pivotal axes of adjacent harness sleeves, "$d_o$" being the diameter of harness sleeves at which abutment occurs, "b" being the distance from the pivotal connection of each ear and the adjacent abutting portion of the associated sleeve and "a" being the distance from each opening and the adjacent abutting portion of the associated sleeve, and $$\theta=N\phi$$

"N" being the number of sleeves that can pivot, and $$\phi = \frac{360°}{\pi}\ \frac{b-a}{d_o}$$

"$\phi$" being the angle in degrees between adjacent sleeves, said harness sleeves pivoting without appreciable resistance in said plane.

* * * * *